US008113187B2

(12) United States Patent
Meyer et al.

(10) Patent No.: US 8,113,187 B2
(45) Date of Patent: Feb. 14, 2012

(54) DELAY COMPENSATION SYSTEMS AND METHODS

(75) Inventors: Jason Meyer, Dayton, OH (US); Shawn W. Midlam-Mohler, Columbus, OH (US); Kenneth P. Dudek, Rochester Hills, MI (US); Stephen Yurkovich, Columbus, OH (US); Yann G. Guezennec, Upper Arlington, OH (US)

(73) Assignee: GM Global Technology Operations LLC

( * ) Notice: Subject to any disclaimer, the term of this patent is extended or adjusted under 35 U.S.C. 154(b) by 331 days.

(21) Appl. No.: 12/570,251

(22) Filed: Sep. 30, 2009

(65) Prior Publication Data

US 2011/0073087 A1 Mar. 31, 2011

(51) Int. Cl.
*F02D 41/00* (2006.01)
*F02D 41/02* (2006.01)

(52) U.S. Cl. ..... 123/703; 701/109

(58) Field of Classification Search ..... 123/703, 123/488, 494, 688; 701/109, 103, 107, 114
See application file for complete search history.

(56) References Cited

U.S. PATENT DOCUMENTS 5,041,981 A * 8/1991 Sekozawa et al. ..... 701/1
7,987,840 B2 * 8/2011 Magner et al. ..... 123/703

OTHER PUBLICATIONS

U.S. Appl. No. 12/570,280, filed Sep. 30, 2009, Jason Meyer.
U.S. Appl. No. 61/247,049, filed Sep. 30, 2009, Sai S.V. Rajagopalan.
Dissertation, Sai S.V. Rajagopalan, Titled: Model Based Control Design and Rapid Calibration for Air to Fuel Ratio Control of Stoichiometric Engines. The Ohio State University, Columbus, OH, 114 pages, 2008.

* cited by examiner

*Primary Examiner* — Mahmoud Gimie

(57) ABSTRACT

A steady-state (SS) delay module determines a SS delay period for SS operating conditions based on an air per cylinder. A dynamic compensation module determines a predicted delay period based on first and second dynamic compensation variables for dynamic operating conditions, the SS delay period, a previous predicted delay period. The first dynamic compensation variable corresponds to a period between a first time when fuel is provided for a cylinder of an engine and a second time when exhaust gas resulting from combustion of the fuel and air is expelled from the cylinder. The SS and predicted delay periods correspond to a period between the first time and a third time when the exhaust gas reaches an exhaust gas oxygen sensor located upstream of a catalyst. A final equivalence ratio module adjusts fuel provided to the cylinder after the third time based on the predicted delay period.

20 Claims, 5 Drawing Sheets

DELAY COMPENSATION SYSTEMS AND METHODS

CROSS-REFERENCE TO RELATED APPLICATIONS

This application is related to U.S. patent application Ser. No. 12/570,280 filed on Sep. 30, 2009 and U.S. Provisional Application No. 61/247,049 filed on Sep. 30, 2009. The disclosures of the above applications are incorporated herein by reference in their entirety.

FIELD

The present disclosure relates to internal combustion engines and more particularly to oxygen sensors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel control system controls provision of fuel to an engine. The fuel control system includes an inner control loop and an outer control loop. The inner control loop may use data from an exhaust gas oxygen (EGO) sensor located upstream of a catalyst in an exhaust system. The catalyst receives exhaust gas output by the engine.

The inner control loop may use the data from the upstream EGO sensor to control an amount of fuel provided to the engine. For example only, when the upstream EGO sensor indicates that the exhaust gas is rich, the inner control loop may decrease the amount of fuel provided to the engine. Conversely, the inner control loop may increase the amount of fuel provided to the engine when the exhaust gas is lean. Adjusting the amount of fuel provided to the engine based on the data from the upstream EGO sensor modulates the air/fuel mixture combusted within the engine at approximately a desired air/fuel mixture (e.g., a stoichiometry mixture).

The outer control loop may use data from an EGO sensor located downstream of the catalyst. For example only, the outer control loop may use the data from the upstream and downstream EGO sensors to determine an amount of oxygen stored by the catalyst and other suitable parameters. The outer control loop may also use the data from the downstream EGO sensor to correct the data provided by the upstream and/or downstream EGO sensors when the downstream EGO sensor provides unexpected data.

SUMMARY

A steady-state (SS) delay module determines a SS delay period for SS operating conditions based on an air per cylinder. A dynamic compensation module determines a predicted delay period based on first and second dynamic compensation variables for dynamic operating conditions, the SS delay period, a previous predicted delay period. The first dynamic compensation variable corresponds to a period between a first time when fuel is provided for a cylinder of an engine and a second time when exhaust gas resulting from combustion of the fuel and air is expelled from the cylinder. The SS and predicted delay periods correspond to a period between the first time and a third time when the exhaust gas reaches an exhaust gas oxygen sensor that is located upstream of a catalyst. A final equivalence ratio module adjusts fuel provided to the cylinder after the third time based on the predicted delay period.

A method comprises: determining a steady-state (SS) delay period for SS operating conditions based on an air per cylinder (APC); determining a predicted delay period based on first and second dynamic compensation variables for dynamic operating conditions, the SS delay period, a previous predicted delay period. The first dynamic compensation variable corresponds to a period between a first time when fuel is provided for a cylinder of an engine and a second time when exhaust gas resulting from combustion of a mixture of the fuel and air is expelled from the cylinder. The SS and predicted delay periods correspond to a period between the first time and a third time when the exhaust gas reaches an exhaust gas oxygen (EGO) sensor that is located upstream of a catalyst. The method further comprises adjusting an amount of fuel provided to the cylinder after the third time based on the predicted delay period.

Further areas of applicability of the present disclosure will become apparent from the detailed description provided hereinafter. It should be understood that the detailed description and specific examples are intended for purposes of illustration only and are not intended to limit the scope of the disclosure.

DETAILED DESCRIPTION

Figure 1:
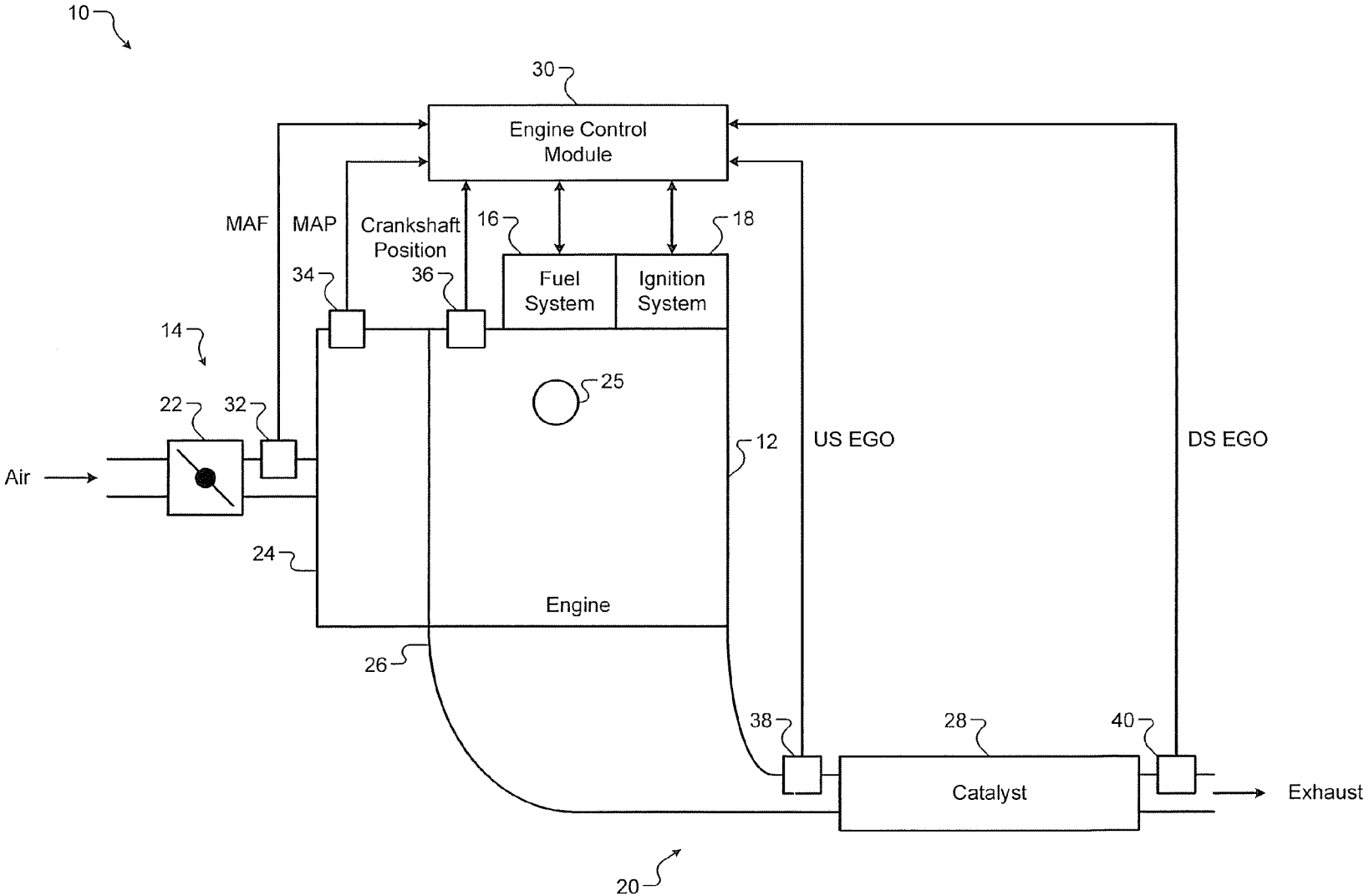
FIG. 1 is a functional block diagram of an exemplary implementation of an engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

An engine control module (ECM) may control an amount of fuel provided to an engine to create a desired air/fuel mixture. Exhaust gas resulting from combustion of an air/fuel mixture is expelled from the engine to an exhaust system. The exhaust gas travels through the exhaust system to a catalyst.

An exhaust gas oxygen (EGO) sensor measures oxygen in the exhaust gas upstream of the catalyst and generates an output based on the measured oxygen.

The ECM determines an expected output of the EGO sensor based on an equivalence ratio (EQR) of the air/fuel mixture provided for combustion. The ECM selectively adjusts the amount of fuel provided during future combustion events based on a difference between the output of the EGO sensor and the expected output. The ECM of the present disclosure delays the use of the expected output to account for a period between when the fuel mixture is provided and when the output of the EGO sensor reflects the measurement of the exhaust gas resulting from combustion of the air/fuel mixture.

Referring now to FIG. 1, a functional block diagram of an exemplary implementation of an engine system 10 is presented. The engine system 10 includes an engine 12, an intake system 14, a fuel system 16, an ignition system 18, and an exhaust system 20. The engine 12 may include, for example, a gasoline type engine, a diesel type engine, a hybrid type engine, or another suitable type of engine.

The intake system 14 includes a throttle 22 and an intake manifold 24. The throttle 22 controls air flow into the intake manifold 24. Air flows from the intake manifold 24 into one or more cylinders within the engine 12, such as cylinder 25. While only the cylinder 25 is shown, the engine 12 may include more cylinders.

The fuel system 16 controls the provision of fuel to the engine 12. The ignition system 18 selectively ignites an air/fuel mixture within the cylinders of the engine 12. The air of the air/fuel mixture is provided via the intake system 14, and the fuel of the air/fuel mixture is provided by the fuel system 16. In some engine systems, such as diesel type engine systems, the ignition system 18 may be omitted.

Exhaust gas resulting from combustion of the air/fuel mixture is expelled from the engine 12 to the exhaust system 20. The exhaust system 20 includes an exhaust manifold 26 and a catalyst 28. For example only, the catalyst 28 may include a catalytic converter, a three way catalyst (TVVC), and/or another suitable type of catalyst. The catalyst 28 receives the exhaust gas output by the engine 12 and reduces the amounts of various components of the exhaust gas.

The engine system 10 also includes an engine control module (ECM) 30 that regulates operation of the engine system 10. The ECM 30 communicates with the intake system 14, the fuel system 16, and the ignition system 18. The ECM 30 also communicates with various sensors. For example only, the ECM 30 may communicate with a mass air flow (MAF) sensor 32, a manifold air pressure (MAP) sensor 34, a crankshaft position sensor 36, and other suitable sensors.

The MAF sensor 32 measures a mass flowrate of air flowing into the intake manifold 24 and generates a MAF signal based on the mass flowrate. The MAP sensor 34 measures pressure within the intake manifold 24 and generates a MAP signal based on the pressure. In some implementations, engine vacuum may be measured with respect to ambient pressure. The crankshaft position sensor 36 monitors rotation of a crankshaft (not shown) of the engine 12 and generates a crankshaft position signal based on the rotation of the crankshaft. The crankshaft position signal may be used to determine an engine speed (e.g., in revolutions per minute). The crankshaft position signal may also be used for cylinder identification.

The ECM 30 also communicates with exhaust gas oxygen (EGO) sensors associated with the exhaust system 20. For example only, the ECM 30 communicates with an upstream EGO sensor (US EGO sensor) 38 and a downstream EGO sensor (DS EGO sensor) 40. The US EGO sensor 38 is located upstream of the catalyst 28, and the DS EGO sensor 40 is located downstream of the catalyst 28. The US EGO sensor 38 may be located, for example, at a confluence point of exhaust runners (not shown) of the exhaust manifold 26 or at another suitable location.

The US and DS EGO sensors 38 and 40 measure oxygen concentration of the exhaust gas at their respective locations and generate an EGO signal based on the oxygen concentration. For example only, the US EGO sensor 38 generates an upstream EGO (US EGO) signal based on the oxygen concentration upstream of the catalyst 28, and the DS EGO sensor 40 generates a downstream EGO (DS EGO) signal based on oxygen concentration downstream of the catalyst 28.

The US and DS EGO sensors 38 and 40 may each include a switching EGO sensor, a universal EGO (UEGO) sensor (i.e., a wide range EGO sensor), or another suitable type of EGO sensor. A switching EGO sensor generates an EGO signal in units of voltage, and switches the EGO signal between a low voltage (e.g., approximately 0.2 V) and a high voltage (e.g., approximately 0.8 V) when the oxygen concentration is lean and rich, respectively. A UEGO sensor generates an EGO signal that corresponds to an equivalence ratio (EQR) of the exhaust gas and provides measurements between rich and lean.

Figure 2:
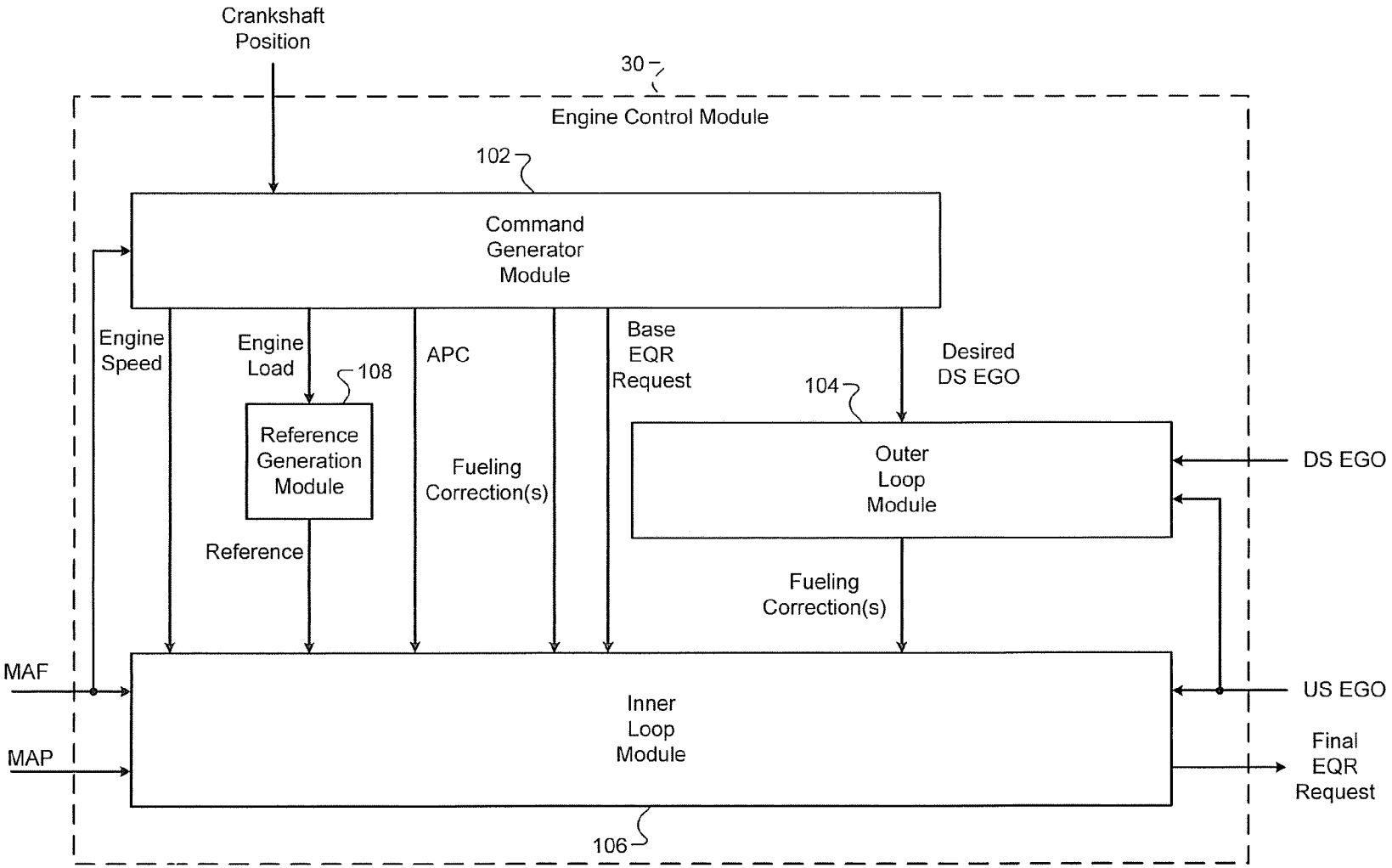
FIG. 2 is a functional block diagram of an exemplary implementation of an engine control module according to the principles of the present disclosure.

Referring now to FIG. 2, a functional block diagram of an exemplary implementation of the ECM 30 is shown. The ECM 30 includes a command generator module 102, an outer loop module 104, an inner loop module 106, and a reference generation module 108. The command generator module 102 may determine engine operating conditions. For example only, the engine operating conditions may include, but are not limited to, the engine speed, air per cylinder (APC), engine load, and/or other suitable parameters. The APC may be predicted for one or more future combustion events in some engine systems. The engine load may be indicated by, for example, a ratio of the APC to a maximum APC of the engine 12.

The command generator module 102 generates a base equivalence ratio (EQR) request. The base EQR request may correspond to a desired equivalence ratio (EQR) of the air/fuel mixture to be combusted within one or more cylinders of the engine 12. For example only, the desired EQR may include a stoichiometric EQR (i.e., 1.0). The command generator module 102 also determines a desired downstream exhaust gas output (a desired DS EGO). The command generator module 102 may determine the desired DS EGO based on, for example, the engine operating conditions.

The command generator module 102 may also generate one or more open-loop fueling corrections for the base EQR request. The fueling corrections may include, for example, a sensor correction and an error correction. For example only, the sensor correction may correspond to a correction to the base EQR request to accommodate the measurements of the US EGO sensor 38. The error correction may correspond to a correction in the base EQR request to account for errors that may occur, such as errors in the determination of the APC and errors attributable to provision of fuel vapor to the engine 12 (i.e., fuel vapor purging).

The outer loop module 104 may also generate one or more open-loop fueling corrections for the base EQR request. The outer loop module 104 may generate, for example, an oxygen storage correction and an oxygen storage maintenance correction. For example only, the oxygen storage correction may correspond to a correction in the base EQR request to adjust the oxygen storage of the catalyst 28 to a desired oxygen storage within a predetermined period. The oxygen storage maintenance correction may correspond to a correction in the base EQR request to modulate the oxygen storage of the catalyst 28 at approximately the desired oxygen storage.

The outer loop module 104 estimates the oxygen storage of the catalyst 28 based on the US EGO signal and the DS EGO signal. The outer loop module 104 may generate the fueling corrections to adjust the oxygen storage of the catalyst 28 to the desired oxygen storage and/or to maintain the oxygen storage at approximately the desired oxygen storage. The outer loop module 104 may also generate the fueling corrections to minimize a difference between the DS EGO signal and the desired DS EGO.

Figure 3:
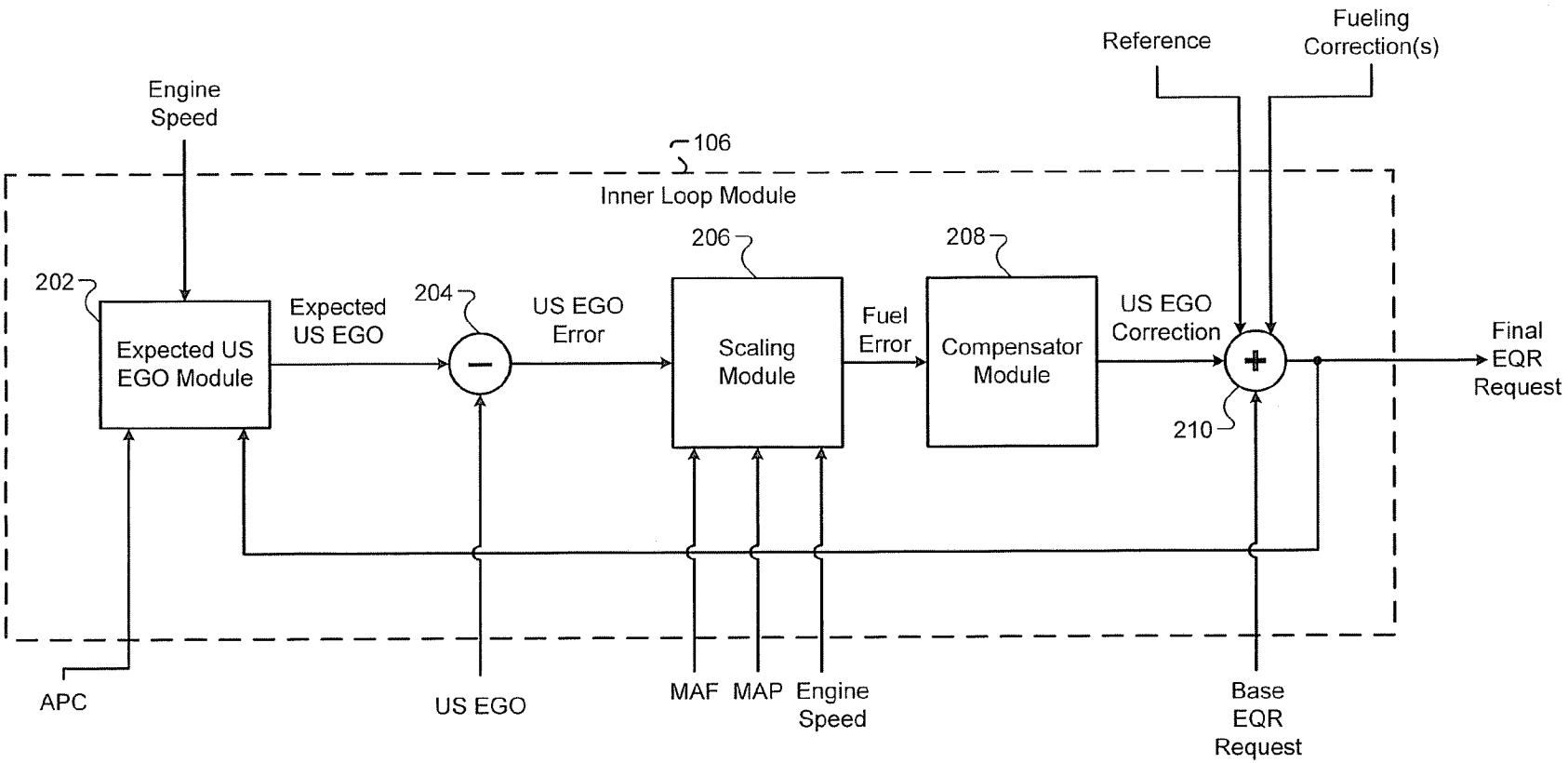
FIG. 3 is a functional block diagram of an exemplary implementation of an inner loop module according to the principles of the present disclosure.

The inner loop module 106 determines an upstream EGO correction (US EGO correction) based on a difference between the US EGO signal and an expected US EGO (see FIG. 3). The US EGO correction may correspond to, for example, a correction in the base EQR request to minimize the difference between the US EGO signal and the expected US EGO.

The reference generation module 108 generates a reference signal. For example only, the reference signal may include a sinusoidal wave, triangular wave, or another suitable type of periodic signal. The reference generation module 108 may selectively vary the amplitude and frequency of the reference signal. For example only, the reference generation module 108 may increase the frequency and amplitude as the engine load increases and may decrease the frequency and amplitude as the engine load decreases. The reference signal may be provided to the inner loop module 106 and one or more other modules.

The inner loop module 106 determines a final EQR request based on the base EQR request and the US EGO correction. The inner loop module 106 determines the final EQR request further based on the sensor correction, the error correction, the oxygen storage correction, and the oxygen storage maintenance correction, and the reference signal. For example only, the inner loop module 106 determines the final EQR request based on a sum of the base fuel command, the US EGO correction, the sensor correction, the error correction, the oxygen storage correction, and the oxygen storage maintenance correction, and the reference signal. The ECM 30 controls the fuel system 16 based on the final EQR request.

Referring now to FIG. 3, a functional block diagram of an exemplary implementation of the inner loop module 106 is presented. The inner loop module 106 may include an expected US EGO module 202, an error module 204, a scaling module 206, a compensator module 208, and a final EQR module 210.

The expected US EGO module 202 determines the expected US EGO. The expected US EGO module 202 determines the expected US EGO based on the final EQR request. However, delays of the engine system 10 prevent the exhaust gas resulting from combustion from being immediately reflected in the US EGO signal. The delays of the engine system 10 may include, for example, an engine delay, a transport delay, and a sensor delay.

The engine delay may correspond to a period between, for example, when fuel is provided for a cylinder of the engine 12 and when the resulting burned air/fuel (exhaust gas) mixture is expelled from the cylinder. The transport delay may correspond to a period between when the resulting exhaust gas is expelled from the cylinder and when the resulting exhaust gas reaches the location of the US EGO sensor 38. The sensor delay may correspond to the delay between when the resulting exhaust gas reaches the location of the US EGO sensor 38 and when the resulting exhaust gas is reflected in the US EGO signal.

The expected US EGO module 202 stores the EQR of the final EQR request. The expected US EGO module 202 determines a delay based on the engine, transport, and sensor delays. The expected US EGO module 202 delays use of the stored EQR until the delay has passed. Once the delay has passed, the stored EQR should correspond to the EQR measured by the US EGO sensor 38.

The error module 204 determines an upstream EGO error (US EGO error) based on the US EGO signal provided by the US EGO sensor 38 and the expected US EGO provided by the expected US EGO module 202. More specifically, the error module 204 determines the US EGO error based on a difference between the US EGO signal and the expected US EGO.

The scaling module 206 determines a fuel error based on the US EGO error. The scaling module 206 may apply one or more gains or other suitable control factors in determining the fuel error based on the US EGO error. For example only, the scaling module 206 may determine the fuel error using the equation:

$$\text{Fuel Error} = \frac{MAF}{14.7} * US\ EGO\ \text{Error}. \tag{1}$$

In another implementation, the scaling module 206 may determine the fuel error using the equation:

$$\text{Fuel Error} = k(\text{MAP},\text{RPM}) * \text{US EGO Error}, \tag{2}$$

where RPM is the engine speed and k is based on a function of the MAP and the engine speed. In some implementations, k may be based on a function of the engine load.

The compensator module 208 determines the US EGO correction based on the fuel error. For example only, the compensator module 208 may apply a proportional-integral (PI) control scheme, a proportional (P) control scheme, a proportional-integral-derivative (PID) control scheme, or another suitable control scheme in determining the US EGO correction based on the fuel error.

The final EQR module 210 determines the final EQR request based on the base EQR request, the reference signal, the US EGO correction, and the one or more open-loop fueling corrections. For example only, the final EQR module 210 may determine the final EQR request based on the sum of the base EQR request, the reference signal, the US EGO correction, and the open-loop fueling corrections. The fuel system 16 controls the provision of fuel to the engine 12 based on the final EQR request. The use of the reference signal in determining the final EQR request may be implemented to, for example, improve the efficiency of the catalyst 28. Additionally, the use of the reference signal may be useful in diagnosing faults in the US EGO sensor 38.

Figure 4:
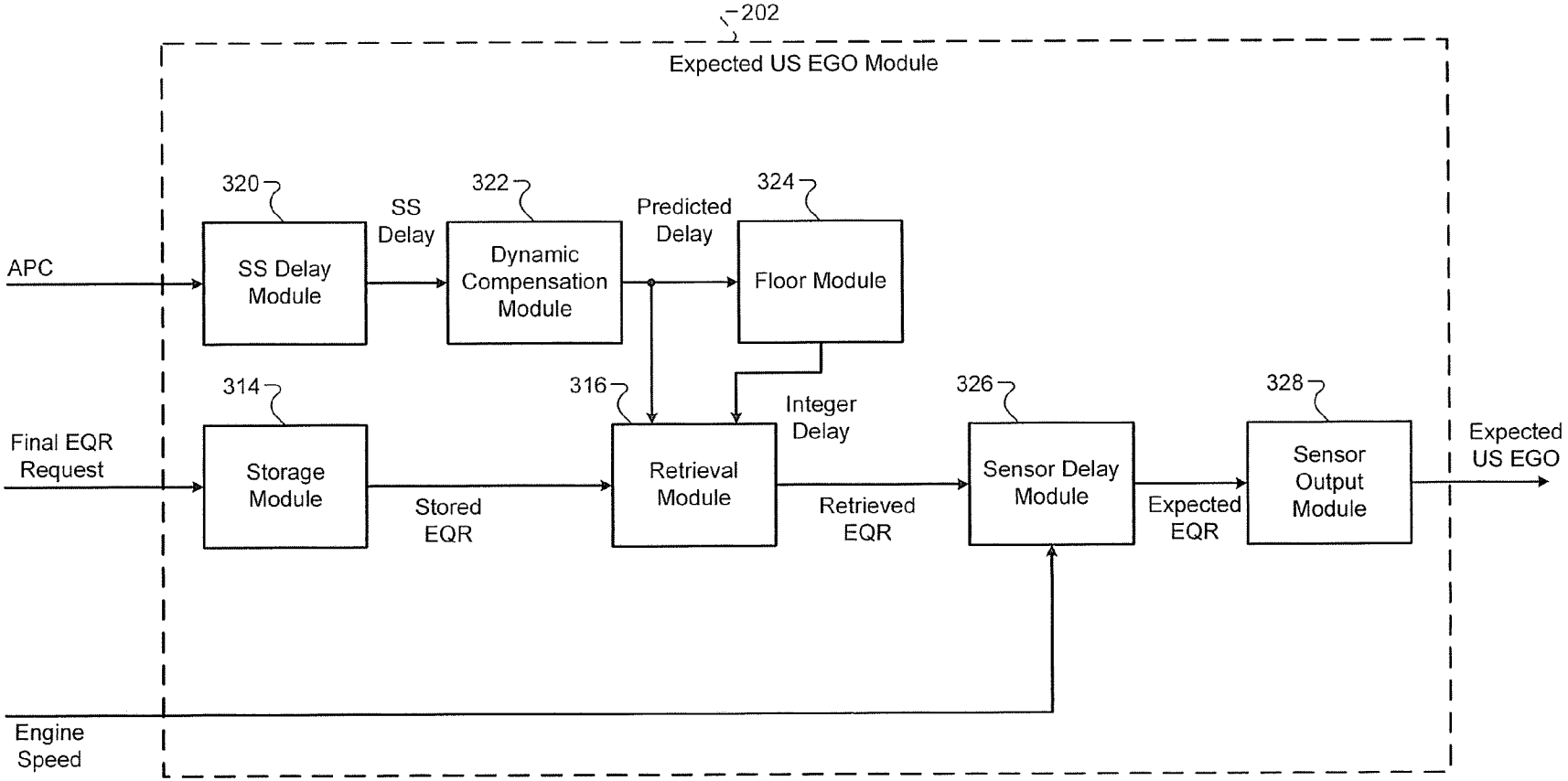
FIG. 4 is a functional block diagram of an expected upstream exhaust gas output module according to the principles of the present disclosure.

Referring now to FIG. 4, a functional block diagram of an exemplary implementation of the expected US EGO module 202 is presented. The expected US EGO module 202 may include a storage module 314, a retrieval module 316, a steady-state delay (SS delay) module 320, and a dynamic compensation module 322. The expected US EGO module 202 may also include a floor module 324, a sensor delay module 326, and a sensor output module 328.

The storage module 314 stores the EQR of the final EQR request in a buffer. For example only, the storage module 314 may include a ring or circular buffer. When the final EQR request is received, the storage module 314 stores the current EQR of the final EQR request in a next location in the buffer. The next location may correspond to, for example, a location in the buffer where an oldest EQR is stored.

The buffer may include a predetermined number of locations. In this manner, the buffer may include the current EQR and N number of stored EQRs, where N is an integer greater than zero and less than the predetermined number. The predetermined number may be calibratable and may be set to, for example, greater than a maximum number of events between when the fuel of the final EQR request is provided and when the resulting burned air/fuel mixture is reflected in the US EGO signal. An event may occur, for example, each time that an air/fuel mixture is ignited within a cylinder of the engine 12 (e.g., a combustion event). For example only, the maximum number may vary between approximately 3 and approximately 4 times the number of cylinders of the engine 12, and the predetermined number may be approximately 5 times the number of cylinders of the engine 12.

The retrieval module 316 selectively retrieves one or more of the N stored EQRs from the storage module 314 and determines a retrieved EQR based on the one or more of the N stored EQRs. For example only, the retrieval module 316 may determine the retrieved EQR based on two of the N stored EQRs. The retrieval module 316 determines the retrieved EQR further based on a predicted delay and an integer delay. The integer delay may correspond to the number of locations in the buffer between the current EQR of the final EQR request and one of the N stored EQRs. The exhaust gas that is likely present at the location of the US EGO sensor 38 is the result of combustion of the air/fuel mixture provided based on the retrieved EQR.

For example only, the retrieval module 316 may determine the retrieved EQR at a given event (k) using the equation:

$$\text{Retrieved EQR}(k)=(1+\text{ID}(k)-\text{PD}(k))*\text{StoredEQR}(k-\text{ID}(k))+(\text{PD}(k)-\text{ID}(k))*\text{StoredEQR}(k-\text{ID}(k)-1), \quad (3)$$

where ID(k) is the integer delay at the event k, PD(k) is the predicted delay at the event k, stored EQR(k−ID(k)) is the stored EQR in the buffer k−ID(k) number of events ago, and stored EQR(k−ID(k)−1) is the stored EQR in the buffer k−ID(k)−1 number of events ago. The determination of the integer delay and the predicted delay are discussed further below.

The SS delay module 320 may determine a steady-state delay (SS delay) based on the APC. For example only, the SS delay module 320 may determine the SS delay based on a steady-state delay model (SS delay module) that includes a mapping of SS delays indexed by APC. In other implementations, the SS delay module 320 may determine the SS delay based on the MAF, the engine load, or another suitable parameter. The length of the SS delay may correspond to a sum of the engine and transport delays during steady-state operating conditions.

The dynamic compensation module 322 determines the predicted delay based on the SS delay. More specifically, the dynamic compensation module 322 determines the predicted delay to account for transients in the APC (i.e., system dynamics) that may cause the SS delay to deviate from an actual delay between when the air/fuel mixture is provided for a cylinder and when the resulting burned air/fuel mixture reaches the location of the US EGO sensor 38. For example only, an increasing APC transient may cause the actual delay to be less than the SS delay. The opposite may be true (i.e., the actual delay may be greater than the SS delay) when a decreasing APC transient occurs.

The dynamic compensation module 322 accounts for APC transients and outputs the predicted delay accordingly. For example only, the dynamic compensation module 322 may determine the predicted delay at a given combustion event (k) using the equation:

$$\text{Predicted Delay}(k)=(K)*\text{SSDelay}(k-n)+(1-K)*\text{PD}(k-1), \quad (4)$$

where SSDelay(k−n) is the SS Delay n number of combustion events ago and PD(k−1) is a last predicted delay output by the dynamic compensation module 322. n and K may be referred to as dynamic compensation variables. The dynamic compensation variables account for APC transients. For example only, the value of K may be set based on whether the APC is increasing or decreasing. The value of n may correspond to a number of events between the fuel injection event and the exhaust event of a cylinder. For example only, the value of n may be equal to 4 in four-cylinder engines and may vary between 6 and 8 in eight-cylinder engines.

The floor module 324 receives the predicted delay and determines the integer delay based on the predicted delay. More specifically, the floor module 324 may apply a floor function to the predicted delay to determine the integer delay. In other words, the floor module 324 may round the predicted delay down to a nearest integer. The floor module 324 provides the integer delay to the retrieval module 316. The retrieval module 316 determines the retrieved EQR based on the predicted delay, the integer delay, and one or more of the stored EQRs as discussed above.

The sensor delay module 326 receives the retrieved EQR from the retrieval module 316, accounts for the sensor delay, and determines an expected EQR based on one or more characteristics of the US EGO sensor 38. The characteristics of the US EGO sensor 38 may include, for example, time constant, porosity, and other suitable characteristics. For example only, the sensor delay module 326 may determine the expected EQR at a given combustion event (k) using the equation:

$$\text{Expected } EQR(k) = \frac{\tau^* N}{\tau^* N + 30} * \text{Expected } EQR(k-1) + \frac{30}{\tau^* N + 30} * \text{Retrieved } EQR(k), \quad (5)$$

where τ is a time constant of the US EGO sensor 38 (e.g., seconds), N is the engine speed, Expected EQR(k−1) is a last expected EQR output by the sensor delay module 326, and Retrieved EQR(k) is the retrieved EQR received from the retrieval module 316 for the event k.

The sensor output module 328 receives the expected EQR from the sensor delay module 326 and determines the expected US EGO based on the expected EQR. For example only, the sensor output module 328 may translate the expected EQR into the units of the US EGO signal (e.g., a voltage when the US EGO sensor 38 includes a switching EGO sensor). In some implementations, such as where the US EGO sensor 38 includes a wide-range EGO sensor, the sensor output module 328 may be omitted and the expected EQR may be compared with the US EGO signal. The sensor output module 328 provides the expected US EGO to the error module 204 for comparison with the US EGO signal provided by the US EGO sensor 38.

Figure 5:
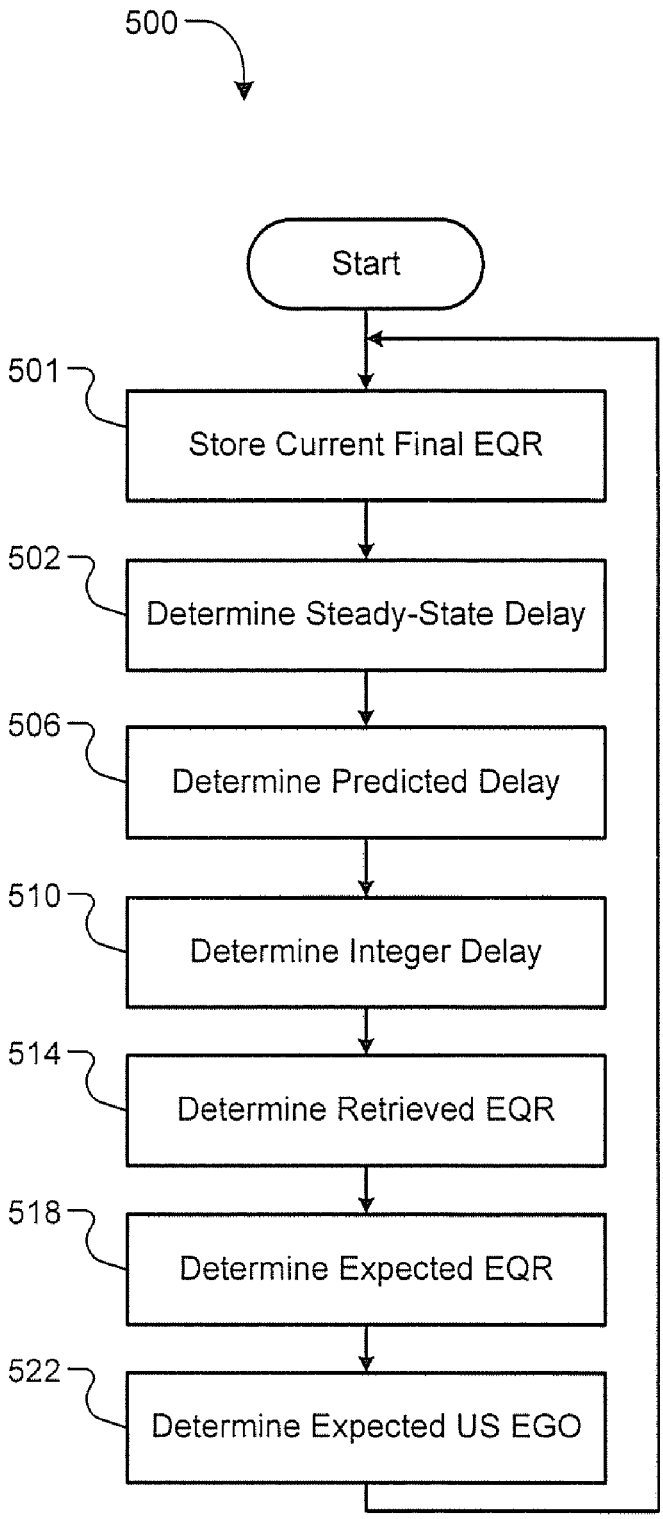
FIG. 5 is a flowchart depicting exemplary steps performed by a method according to the principles of the present disclosure.

Referring now to FIG. 5, a flowchart depicting an exemplary method 500 is presented. Control may begin in step 501 where control stores the EQR of the final EQR request. In other words, control stores the current final EQR in step 501. In step 502, control determines the SS delay. Control may determine the SS delay based on, for example, the APC. Control determines the predicted delay in step 506. For example only, control may determine the predicted delay using equation (4) as discussed above.

In step 510, control determines the integer delay. Control may determine the integer delay based on the application of a floor function to the predicted delay. In other words, control may round the predicted delay down to the nearest integer to determine the integer delay in step 510. Control determines the retrieved EQR in step 514. Control may determine the retrieved EQR based on the predicted delay, the integer delay, and one or more of the N stored EQRs. For example only, control may determine the retrieved EQR using equation (3) as discussed above.

Control determines the expected EQR in step 518. Control may determine the expected EQR based on the stored EQR and the characteristics of the US EGO sensor 38. For example only, control may determine the expected EQR using equation (5) as discussed above. Control determines the expected US EGO in step 522. For example only, control may determine the expected US EGO by translating the expected EQR into the units of the US EGO signal. Control then returns to step 501.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system for a vehicle, comprising:

a steady-state (SS) delay module that determines a SS delay period for SS operating conditions based on an air per cylinder (APC);

a dynamic compensation module that determines a predicted delay period based on first and second dynamic compensation variables for dynamic operating conditions, the SS delay period, a previous predicted delay period, wherein the first dynamic compensation variable corresponds to a period between a first time when fuel is provided for a cylinder of an engine and a second time when exhaust gas resulting from combustion of a mixture of the fuel and air is expelled from the cylinder, and wherein the SS and predicted delay periods correspond to a period between the first time and a third time when the exhaust gas reaches an exhaust gas oxygen (EGO) sensor that is located upstream of a catalyst; and a final equivalence ratio (EQR) module that adjusts an amount of fuel provided to the cylinder after the third time based on the predicted delay period.

2. The system of claim 1 wherein the dynamic compensation module determines the predicted delay period based on a sum of first and second delay periods, determines the first delay period based on a first product of the SS delay period and the second dynamic compensation variable, and determines the second delay period based on a second product of the previous predicted delay period and the second dynamic compensation variable.

3. The system of claim 2 wherein the previous predicted delay period corresponds to a last predicted delay period determined by the dynamic compensation module.

4. The system of claim 2 wherein the SS delay period corresponds to the SS delay period determined by the SS delay module a number of combustion events before the first time, wherein the number is the first dynamic compensation variable.

5. The system of claim 2 wherein the second dynamic compensation variable is one of a first value and a second value.

6. The system of claim 1 wherein the dynamic compensation module selectively sets the second dynamic compensation variable to one of a first value and a second value based on the APC, wherein the first and second values are unequal.

7. The system of claim 6 wherein the dynamic compensation module sets the second dynamic compensation variable to one of the first and second values when the APC is increasing and to the other one of the first and second values when the APC is decreasing.

8. The system of claim 1 further comprising:

a sensor delay module that determines an expected equivalence ratio (EQR) of the exhaust gas based on the predicted delay;

a sensor output module that selectively translates the expected EQR into units of an EGO measurement output by the EGO sensor; and an error module that determines an error based on a difference between the expected EQR and the EGO measurement.

9. The system of claim 8 wherein the final EQR module adjusts the amount of fuel provided to the cylinder after the third time based on the error.

10. The system of claim 8 further comprising a retrieval module that retrieves one or more equivalence ratios (EQRs) of air/fuel mixtures provided to the cylinder before the first time and that determines a retrieval EQR based on the one or more equivalence ratios and the predicted delay, wherein the sensor delay module determines the expected EQR based on the retrieved EQR.

11. A method for a vehicle, comprising:

determining a steady-state (SS) delay period for SS operating conditions based on an air per cylinder (APC);

determining a predicted delay period based on first and second dynamic compensation variables for dynamic operating conditions, the SS delay period, a previous predicted delay period, wherein the first dynamic compensation variable corresponds to a period between a first time when fuel is provided for a cylinder of an engine and a second time when exhaust gas resulting from combustion of a mixture of the fuel and air is expelled from the cylinder, and wherein the SS and predicted delay periods correspond to a period between the first time and a third time when the exhaust gas reaches an exhaust gas oxygen (EGO) sensor that is located upstream of a catalyst; and adjusting an amount of fuel provided to the cylinder after the third time based on the predicted delay period.

12. The method of claim 11 further comprising:

determining the predicted delay period based on a sum of first and second delay periods;

determining the first delay period based on a first product of the SS delay period and the second dynamic compensation variable; and determining the second delay period based on a second product of the previous predicted delay period and the second dynamic compensation variable.

13. The method of claim 12 wherein the previous predicted delay period corresponds to a last predicted delay period determined.

14. The method of claim 12 wherein the SS delay period corresponds to the SS delay period determined a number of combustion events before the first time, wherein the number is the first dynamic compensation variable.

15. The method of claim 12 wherein the second dynamic compensation variable is one of a first value and a second value.

16. The method of claim 11 further comprising selectively setting the second dynamic compensation variable to one of a first value and a second value based on the APC, wherein the first and second values are unequal.

17. The method of claim 16 further comprising setting the second dynamic compensation variable to one of the first and second values when the APC is increasing and to the other one of the first and second values when the APC is decreasing.

18. The method of claim 11 further comprising:

determining an expected equivalence ratio (EQR) of the exhaust gas based on the predicted delay;

selectively translating the expected EQR into units of an EGO measurement output by the EGO sensor; and determining an error based on a difference between the expected EQR and the EGO measurement.

19. The method of claim 18 further comprising adjusting the amount of fuel provided to the cylinder after the third time based on the error.

20. The method of claim 18 further comprising:

retrieving one or more equivalence ratios (EQRs) of air/fuel mixtures provided to the cylinder before the first time;

determining a retrieval EQR based on the one or more equivalence ratios and the predicted delay; and determining the expected EQR based on the retrieved EQR.

* * * * *